United States Patent [19]

Tanaka et al.

[11] Patent Number: 4,678,428

[45] Date of Patent: Jul. 7, 1987

[54] MULTISTAGE FUEL BURNER HAVING A HELICALLY RISING COLUMN OF AIR-FUEL MIXTURE

[75] Inventors: Eiichi Tanaka, Yamatokoriyama; Koro Furumai, Ikoma; Fumitaka Kikutani, Nara, all of Japan

[73] Assignee: Matsushita Electric Industrial Co., Ltd., Japan

[21] Appl. No.: 816,630

[22] Filed: Jan. 6, 1986

[30] Foreign Application Priority Data

Jan. 10, 1985 [JP] Japan ..... 60-2325
Jun. 20, 1985 [JP] Japan ..... 60-134517

[51] Int. Cl.[4] ..... F23N 5/00
[52] U.S. Cl. ..... 431/76; 431/355
[58] Field of Search ..... 431/76, 80, 355

[56] References Cited

U.S. PATENT DOCUMENTS 1,296,507 3/1919 Hansen ..... 431/355
1,313,694 8/1919 Hunter ..... 431/355
3,295,585 1/1967 Kovach et al. ..... 431/76
4,315,729 2/1982 Tanaka et al. .

FOREIGN PATENT DOCUMENTS 126734 9/1980 Japan ..... 431/76

*Primary Examiner*—Carroll B. Dority, Jr.
*Attorney, Agent, or Firm*—Lowe, Price, LeBlanc, Becker & Shur

[57] ABSTRACT

Disclosed is a fuel burner comprising a nozzle for ejecting fuel, an inner tube having an inlet end for receiving the fuel from the nozzle. The inner tube has first and secod air inlet ports adjacent to and located in positions spaced longitudinally apart in the direction of axis of the inner tube and angularly apart about said axis for introducing primary air into the inner tube so as to produce a helically rising column of air-fuel mixture and providing primary combustion at the outlet end thereof. An outer tube coaxially surrounding the inner tube has secondary air inlet ports for introducing secondary air thereinto to provide secondary combustion at an outlet end. A sensor is located between the outlet ends of the inner and outer tubes for detecting the presence of the primary combustion.

7 Claims, 2 Drawing Figures

MULTISTAGE FUEL BURNER HAVING A HELICALLY RISING COLUMN OF AIR-FUEL MIXTURE

BACKGROUND OF THE INVENTION

The present invention relates to an improvement of an open-type fuel burner, and more particularly to such a fuel burner having a safety device for alerting the user or shutting off the supply of fuel when the oxygen content of air decreases below a prescribed level.

Fuel burners of the open-type find widespread use in applications where the portability and cost of a heating appliance are of primary concern. However, the recirculation of the air heated by the burner in a closed environment eventually depletes the oxygen content of the air in it and for this reason an oxygen sensor is provided to give a warning indication or automatically shut off the supply of fuel when the oxygen content falls below a predetermined level.

U.S. Pat. No. 4,315,729 issued to Tanaka et al, and assigned to the same assignee as the present invention, discloses a multistage gas burner having an inner tube and an outer tube arranged so that the inner tube mixes gas with primary air and produces a primary combustion flame at its outlet end and the outer tube mixes unburned gas with secondary air to cause a secondary flame to burn at its outlet end. A sensor is provided between the outlet ends of the inner and outer tubes to detect the absence of the primary combustion to trigger a safety device.

Because of the portability of the heating appliance of the above-mentioned type, it is desired that the size of the burner be kept as small as possible. Attempts at reducing the burner size, however, have resulted in an increase in temperature in the various parts of the burner, producing harmful products (NOx), "backfire" and unstable combustions.

In the aforesaid patent, the inner tube has a primary air inlet port located adjacent to the gas nozzle. However, the airstream drawn into the inner tube through the primary port by the ejected gas comes into a violent contact with the gas flow at the center of the inner tube and produces a mixture of air and gas which tends to tilt against the wall of the inner tube, thus resulting in a loss of uniformity in the distribution of gas and oxygen molecules in the mixture. As a result, the primary flame increases its length, causing the separation between it and the secondary flame ambiguous, which makes it difficult for the sensor to distinguish between normal and dangerous conditions. This problem can be cured only at the expense of size reduction.

SUMMARY OF THE INVENTION

It is therefore an object of the present invention to provide a fuel burner which is compact, ensures a low NOx emission level, and uniform distribution of fuel and oxygen to provide clear separation between primary and secondary flames.

This object is obtained by forming two primary air inlet ports in positions differently spaced axially from the fuel supply nozzle to cause air introduced therethrough to combine with the fuel in a helically rising column of air and gas mixture.

More specifically, the fuel burner of the present invention comprises a nozzle for ejecting fuel and an inner tube having an inlet end for receiving the fuel from the nozzle. The inner tube has first and second air inlet ports adjacent to and located in positions spaced longitudinally apart in the direction of axis of the inner tube and angularly apart about said axis for introducing primary air into the inner tube to produce a helically rising column of air-fuel mixture and providing primary combustion of the mixture at an outlet end thereof. An outer tube coaxially surrounding the inner tube has secondary air inlet ports for introducing secondary air into the outer tube to provide secondary combustion at an outlet end thereof. A sensor is located between the outlet ends of the inner and outer tubes for detecting the presence of the primary combustion.

BRIEF DESCRIPTION OF THE DRAWINGS

The present invention will be described in further detail with reference to the accompanying drawings, in which.

DETAILED DESCRIPTION

Figure 1:
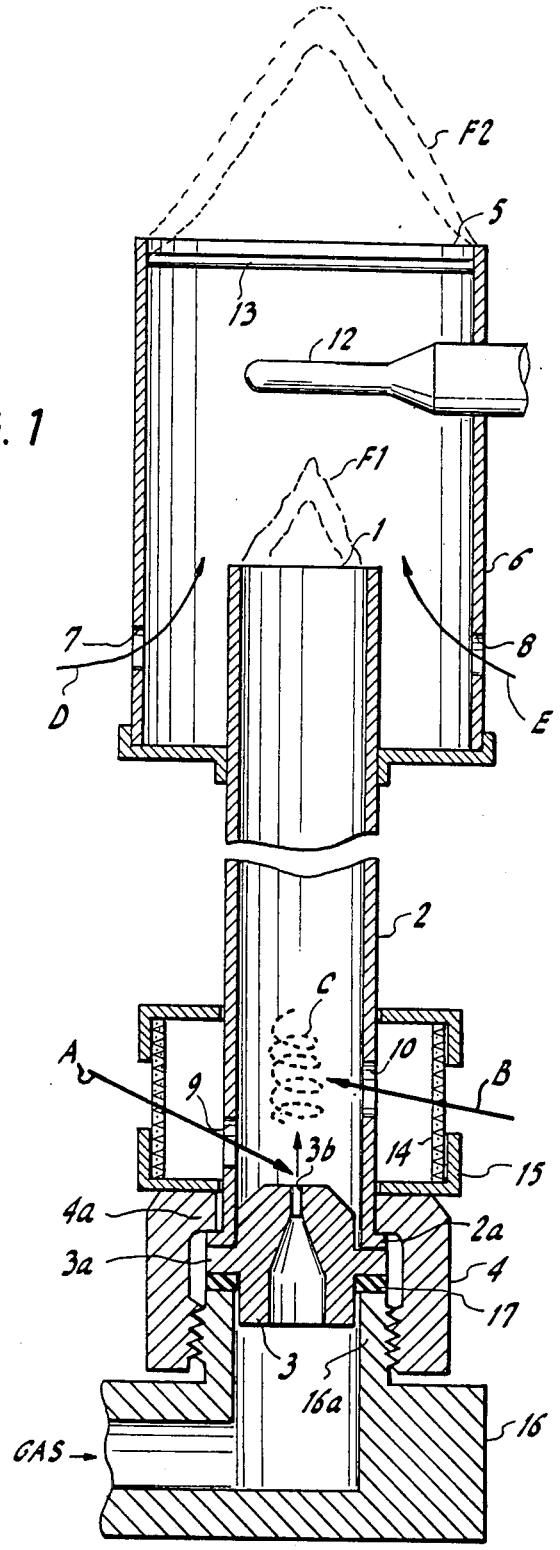
FIG. 1 is a cross-sectional view in elevation of a fuel burner according to a preferred embodiment of the invention.

Referring to FIG. 1, there is shown a fuel burner according to a preferred embodiment of the invention. The burner comprises a gas supply base 16, a gas-ejection nozzle 3 mounted air-tightly by a rubber packing 17 on the base 16, an inner tube 2 having an outlet end 1 which defines a primary flame cone mouth and an outer tube 6 having an outlet end 5 forming a secondary flame cone mouth. Inner tube 2 has a flange 2*a* which is seated on a flage 3*a* of nozzle 3. A ring-shaped coupling member 4 has an inwardly bent portion 4*a* engaging with the flange 2*a* of inner tube 2 and an internally threaded portion engaging with an externally threaded portion 16*a* of base 16 to secure the inner tube 2 in position by a rubber packing 17 interposed between portion 16 and flange 2*a*. Adjacent the nozzle opening 3*b*, inner tube 2 is formed with a pair of primary air inlet ports 9 and 10 located adjacent the nozzle opening 3*b* in positions spaced longitudinally apart in the direction of axis of tube 2 and angularly apart by 180 degrees. An air inlet guide 15 having an air filter 14 is mounted on the coupling member 4 to allow the introduction of primary air into tube 2 through port 9 downwardly at an angle to the direction of gas ejected through the nozzle opening 3*b* as indicated by an arrow A and the introduction of primary air through port 10 as indicated by an arrow B.

Outer tube 6 is coaxially mounted on the inner tube 2 so that it surrounds the upper portion of inner tube 2. Outer tube 6 is provided with a pair of secondary air inlet ports 7 and 8 located in positions below the outlet end 1 of inner tube 2 for introducing secondary air.

A primary combustion detector 12 extends into the outer tube 6 in a position between the outlet ends 1 and 5 to detect the presence of a primary combustion flame. Detector 12 may comprises an oxygen depletion sensor or a temperature sensor.

Ejection of gas from nozzle opening 3*b* causes primary air as indicated by arrows A and B to be sucked into the tube 2. Because of the difference in height, the introduced air combines with the gas and produces a helical flow C rising upwards without contacting the inner of tube 2. The helically rising flow quickly produces a uniform mixture of oxygen and gas. The air-fuel mixture thus burns efficiently at outlet end 1 in a stable manner with the aid of secondary air introduced through ports 7 and 8 as indicated by arrows D and E to produce a primary combustion flame cone F1 having a length terminating in a position well below the sensor 12 during normal, oxygen-rich conditions. It has been found that the introduction of air at downwardly tilted angle through the inlet port 9 is effective in aiding the production of the spiral flow and hence the uniform mixing of gas and oxygen. Secondary air introduced to the outer tube 6 is mixed with unburned residual gas and produces a secondary, diffusive combustion flame F2 at the outlet end 5, which is separated from the primary flame with a clear distinction. Because of this distinct separation, sensor 12 can be located in an appropriate position between outlet ends 1 and 5 to generate a voltage during oxygen-rich conditions which is higher than is available with the prior art gas burner. Under this condition, the primary combustion flame is rendered quickly responsive to depletion of the oxygen content of air and burned at temperatures at which the NOx content of emission from inner tube 2 is not harmful.

Figure 2:
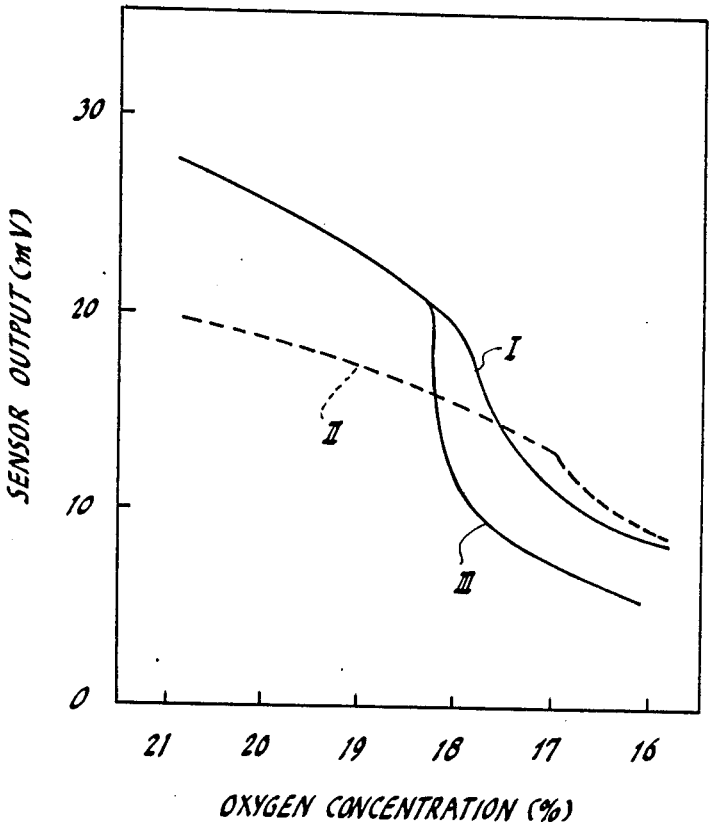
FIG. 2 is a graphic representation of sensor output voltage plotted as a function of oxygen concentration for comparison with a prior art burner.

With depletion of oxygen content, the primary combustion flame F1 diminishes gradually and on reaching an oxygen content below 18%, the flame diminishes sharply, causing the sensor output to rapidly drop as indicated by a solid-line curve I in FIG. 2. Whereas, the prior art burner exhibits a gradually decreasing sensor output with the decrease in oxygen content as indicated by a broken-line curve II due to the lack of distinct separation between primary and secondary flames. It has been confirmed that for efficient operation of the gas burner it is preferred that the ratio of the cross-sectional area of the flame cone mouth 5 of the outer tube to the cross-sectional area of the flame cone mouth 1 of the inner tube 2 be in the range between 2.12:1 and 25:1. The efficient operation of fuel burner in relation to the cross-sectional areas noted above has been dealt with extensively in the aforesaid United States patent. This patent is incorporated here by reference as if set forth fully herein.

It has been observed that when the oxygen-content drops below the 18% value, the combustion at the outlet end 5 tends to produce a "flash back", so that the base of its flame cone is formed on the sensor 12, with a slight loss of separation between the primary and secondary flames. To ensure separation between these flames during such oxygen-depleted conditions, it is preferred to provide a means to prevent the formation of the secondary flame cone base in a position lower than outlet end 5. For this purpose, a rod 13 is provided, the rod extending diametrically across the outer tube 2 near secondary flame outlet end 5. Due to the Coanda effect that is produced by the gas moving past the rod 13 and the perimeter of outlet end 5, secondary combustion is caused to occur around the circumference of rod 13 and the perimeter of the outlet end 5. Due to the provision of rod 13, the effect of the secondary flame on sensor 12 is minimized and its output drops more sharply than the sensor output curve I when the oxygen concentration drops below the critical point as indicated by a solid-line curve III in FIG. 2.

The foregoing description shows only preferred embodiments of the present invention. Various modifications will be apparent to those skilled in the art without departing from the scope of the present invention which is only limited by the appended claims. Therefore, the embodiments shown and described are only illustrative and not restrictive.

What is claimed is:

1. A fuel burner comprising:

a nozzle for ejecting fuel;

an inner tube having an inlet end for receiving the fuel from said nozzle, said inner tube having first and second air inlet ports adjacent to said nozzle and located in positions spaced longitudinally apart sequentially in the downstream direction of said inner tube and spaced angularly apart from said axis;

means, coacting with said inner tube, for directing a first air flow into said inner tube through said first air inlet port with a velocity component in the upstream direction toward said fuel nozzle and for directing a second air flow into said inner tube through said second air inlet port with a velocity component in the downstream direction away from said nozzle to thereby produce a helically rising column of mixture of fuel and oxygen and providing primary combustion of the mixture at an outlet end thereof, said inner tube having no other air inlet ports upstream of said second air inlet port;

an outer tube surrounding and coaxial with the inner tube, the outer tube having secondary air inlet ports for introducing secondary air into the outer tube to provide secondary combustion at an outlet end thereof; and a sensor located between the outlet ends of said inner and outer tubes for detecting the presence of said primary combustion.

2. A fuel burner as claimed in claim 1, wherein said inner tube is vertical with the nozzle ejecting said fuel upwardly therein, said first air inlet port is located adjacent said nozzle and said second port is located remote from the nozzle, said means for directing air through said first air inlet port into said inner tube directing said first air flow downwardly at an angle to the flow of said fuel emitted from said nozzle.

3. A fuel burner as claimed in claim 1, further comprising means located adjacent the outlet end of said outer tube for preventing said secondary combustion from occurring in an area adjacent said sensor.

4. A fuel burner as claimed in claim 2, further comprising means located adjacent the outlet end of said outer tube for preventing said secondary combustion from occurring in an area adjacent said sensor.

5. A fuel burner as claimed in claim 3, wherein said means comprises a rod extending diametrically across said outlet end to the outer tube.

6. A fuel burner as claimed in claim 1, wherein said first and second air inlet ports are located angularly apart by 180 degrees.

7. A fuel burner as claimed in claim 1, wherein the ratio of the cross-sectional area of the outlet end of the outer tube to the cross-sectional area of the outlet end of the inner tube is in the range between 2.12:1 and 25:1.

* * * * *